US008584448B2

(12) United States Patent
Ishida et al.

(10) Patent No.: US 8,584,448 B2
(45) Date of Patent: Nov. 19, 2013

(54) CYLINDER HEAD FOR AN INTERNAL COMBUSTION ENGINE, ENGINE INCORPORATING THE CYLINDER HEAD, AND METHOD OF MAKING SAME

(75) Inventors: Junichi Ishida, Saitama (JP); Masaaki Negoro, Saitama (JP); Yosuke Ariga, Saitama (JP); Takanori Osuka, Saitama (JP); Tomiyuki Sasaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 153 days.

(21) Appl. No.: 13/228,582

(22) Filed: Sep. 9, 2011

(65) Prior Publication Data

US 2012/0067318 A1 Mar. 22, 2012

(30) Foreign Application Priority Data

Sep. 17, 2010 (JP) ..... 2010-210095

(51) Int. Cl.
*F01N 7/08* (2006.01)
*F02F 1/42* (2006.01)
*F02B 27/04* (2006.01)

(52) U.S. Cl.
USPC ..... 60/322; 60/323

(58) Field of Classification Search
USPC ..... 60/312, 313, 323, 324, 314; 123/193.5
See application file for complete search history.

(56) References Cited

U.S. PATENT DOCUMENTS

| | | | | |
|---|---|---|---|---|
| 4,522,029 | A * | 6/1985 | Tomita et al. | 60/314 |
| 7,503,171 | B2 * | 3/2009 | Saito | 60/323 |
| 2009/0084098 | A1 * | 4/2009 | Tsubakino et al. | 60/324 |
| 2010/0126153 | A1 * | 5/2010 | Nagafuchi | 60/299 |
| 2012/0011837 | A1 * | 1/2012 | Navathe et al. | 60/324 |

FOREIGN PATENT DOCUMENTS

JP 4-52992 U 5/1992

* cited by examiner

*Primary Examiner* — Marguerite McMahon
(74) *Attorney, Agent, or Firm* — Carrier Blackman & Associates, P.C.; William D. Blackman; Michael J. McCandlish

(57) ABSTRACT

A motorcycle includes an engine configured to expel an exhaust from combustion chambers of cylinders in a cylinder head through exhaust ports. Each of the cylinders is provided with a recessed portion provided in an exhaust passage wall surface in a central portion of an exhaust passage of a corresponding exhaust port. This makes it possible to maintain flow rate and flow velocity of the exhaust gas, and to decrease exhaust loss. As a result, it is possible to increase engine torque by use of a simple structure. In addition, no restriction is imposed on the layout of parts around the engine, because the recessed portions are provided in the exhaust ports.

20 Claims, 12 Drawing Sheets

CYLINDER HEAD FOR AN INTERNAL COMBUSTION ENGINE, ENGINE INCORPORATING THE CYLINDER HEAD, AND METHOD OF MAKING SAME

CROSS-REFERENCE TO RELATED APPLICATIONS

The present invention claims priority under 35 USC 119 based on Japanese patent application No. 2010-210095, filed on 17 Sep. 2010. The entire subject matter of this priority document, including specification, claims and drawings, is incorporated by reference herein.

BACKGROUND OF THE INVENTION

1. Field of the Invention

The present invention relates to an internal combustion engine. The present invention relates particularly to an internal combustion engine having an improved exhaust port structure, and a method of manufacturing the same.

2. Description of the Background Art

Conventional motorcycles may include, for example, a sub-chamber in the middle of an exhaust pipe of an exhaust device connected to a four-cycle internal combustion engine (see Japanese Utility Model Registration Application Publication No. Hei 4-52992, for example). The sub-chamber is made of a metal plate or the like in the shape of a box or a case. The inside of the sub-chamber is hollow. The sub-chamber has a structure in which the hollow portion of the sub-chamber communicates with the exhaust pipe through a communication hole, which is provided in an appropriate location in the exhaust pipe.

With the volume of the exhaust pipe increased, the sub-chamber thus configured, for example, absorbs exhaust pulsation in the low rotary speed range of the internal combustion engine, and enhances the intake/exhaust efficiency by using the reflection waves of the exhaust pulsation.

In the structure of the motorcycle having the foregoing internal combustion engine, however, the provision of the sub-chamber makes the sub-chamber likely to interfere with parts around the location in which the sub-chamber is set, and hence imposes restriction on the layout of the parts. In addition, the conventional practice is to form the sub-chamber in the shape of a case from a metal plate or the like, as described above. This entails a problem that the production of the sub-chamber increases not only the number of parts but also the number of manufacturing steps because the production needs a bending process for the metal plate.

The present invention has been made in view of the foregoing situation. An object of the present invention is to provide an internal combustion engine having a sub-chamber function which: does not interfere with parts around its set location; imposes no restriction on the layout of the parts; and does not increase the number of parts or the number of manufacturing steps.

In addition, another object of the present invention is to provide a method of manufacturing the internal combustion engine having the sub-chamber function which imposes no restriction on the layout, and which does not increase the number of manufacturing steps.

SUMMARY OF THE INVENTION

To achieve the above-described object, a first aspect of the present invention is an internal combustion engine which is configured to expel an exhaust from a combustion chamber in a cylinder in a cylinder head through an exhaust port connected to an exhaust pipe, the internal combustion engine characterized in that a recessed portion set back from the rest of an exhaust passage wall surface is provided in the middle of an exhaust passage of the exhaust port.

A second aspect of the present invention, in addition to the configuration of the first aspect of the present invention, is characterized in that the internal combustion engine comprises a plurality of cylinders, and a plurality of the recessed portions are formed in accordance with the number of cylinders.

A third aspect of the present invention, in addition to the configuration of any one of the first and second aspects of the present invention, is characterized in that the recessed portion is provided upstream of an confluence section, in which a plurality of the exhaust ports join together, in the exhaust passage.

A fourth aspect of the present invention, in addition to the configuration of any one of the first to third aspects of the present invention, is characterized in that the recessed portion is provided in an area in which a curvature is large in an inner wall of the exhaust port.

A fifth aspect of the present invention, in addition to the configuration of any one of the first to fourth aspects of the present invention, is characterized in that the exhaust ports comprise a plurality of inner exhaust ports and a plurality of outer exhaust ports which are placed laterally outside the respective inner exhaust ports, the outer exhaust ports are designed to curve toward the respective inner exhaust ports, and the recessed portion is placed outside a curved portion of each outer exhaust port.

A sixth aspect of the present invention, in addition to the first to fifth aspects of the present invention, is characterized in that a plurality of the recessed portions are provided, and locations in which the recessed portions are formed are placed in positions passing the exhaust ports and symmetrical with respect to a center line of the cylinder head.

A seventh aspect of the present invention, in addition to the configuration of any one of the first to sixth aspects of the present invention, is characterized in that an internal space of each recessed portion is formed in a cylindrical shape.

An eighth aspect of the present invention is characterized in that while the internal combustion engine of any one of the first to seventh aspects of the present invention is manufactured, each recessed portion is formed by using a core in a process of casting the cylinder head.

Effects of the Invention

According to the first aspect of the present invention, the reduction in the flow rate and flow velocity of the exhaust gas can be prevented and accordingly the exhaust loss can be reduced, because the exhaust gas discharged from the combustion chamber enters the recessed portion in the exhaust port. As a result, the torque of the internal combustion engine can be increased with the very simple structure. In addition, because of the structure in which the recessed portion is provided in the exhaust port, no restriction is imposed on the layout of parts around the internal combustion engine.

According to the second aspect of the present invention, even a vehicle having multiple cylinders can exert an effect of preventing the reduction in the flow rate and flow velocity of the exhaust gas in each cylinder, and accordingly the output of the internal combustion engine can be increased effectively.

According to the third aspect of the present invention, the flow of the exhaust gas is made better in the upstream portion in the exhaust passage, and accordingly the flow in the exhaust ports as a whole is made better. In addition, the rigidity around the confluence section can be increased, because in each location in which the recessed portion is provided, the wall portion constituting the corresponding exhaust port has a structure including recesses and projections depending on the necessity.

According to the fourth aspect of the present invention, the volume of each exhaust port can be increased and hence the flow of the exhaust gas is made smoother as well as accordingly the exhaust loss can be prevented, because the corresponding recessed portion is provided in an area in which a curvature is large in the inner wall surface of the exhaust port.

According to the fifth aspect of the present invention, the space can be used efficiently and accordingly each area in which the recessed portion is provided is allowed to be enlarged in size, because each recessed portion is placed outside the area where the corresponding outer exhaust port is curved, that is to say, in the area constituting a small space (a curved unoccupied space) which is created by inwardly curving a corresponding portion of the cylinder head.

According to the sixth aspect of the present invention, even in the structure in which the recessed portions are provided to the multiple cylinders in the internal combustion engine having the multiple cylinders, conditions for the placement locations of the recessed portions are the same throughout the cylinders, and hence the outputs from the cylinders are equalized by suppressing the occurrence of the variation among the outputs, as well as accordingly the output of the internal combustion engine is increased.

According to the seventh aspect of the present invention, the productivity is made better than when each recessed portion is shaped like, for example, a square pole which has angled corners. In particular, when the cylinder head is produced by casting, the invention makes it easier to expel sand during the casting, and accordingly enhances the productivity.

According to the eighth aspect of the present invention, the productivity of the internal combustion engine having the sub-chamber function is enhanced, because each recessed portion can be simply produced by use of a core while the cylinder head is cast.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
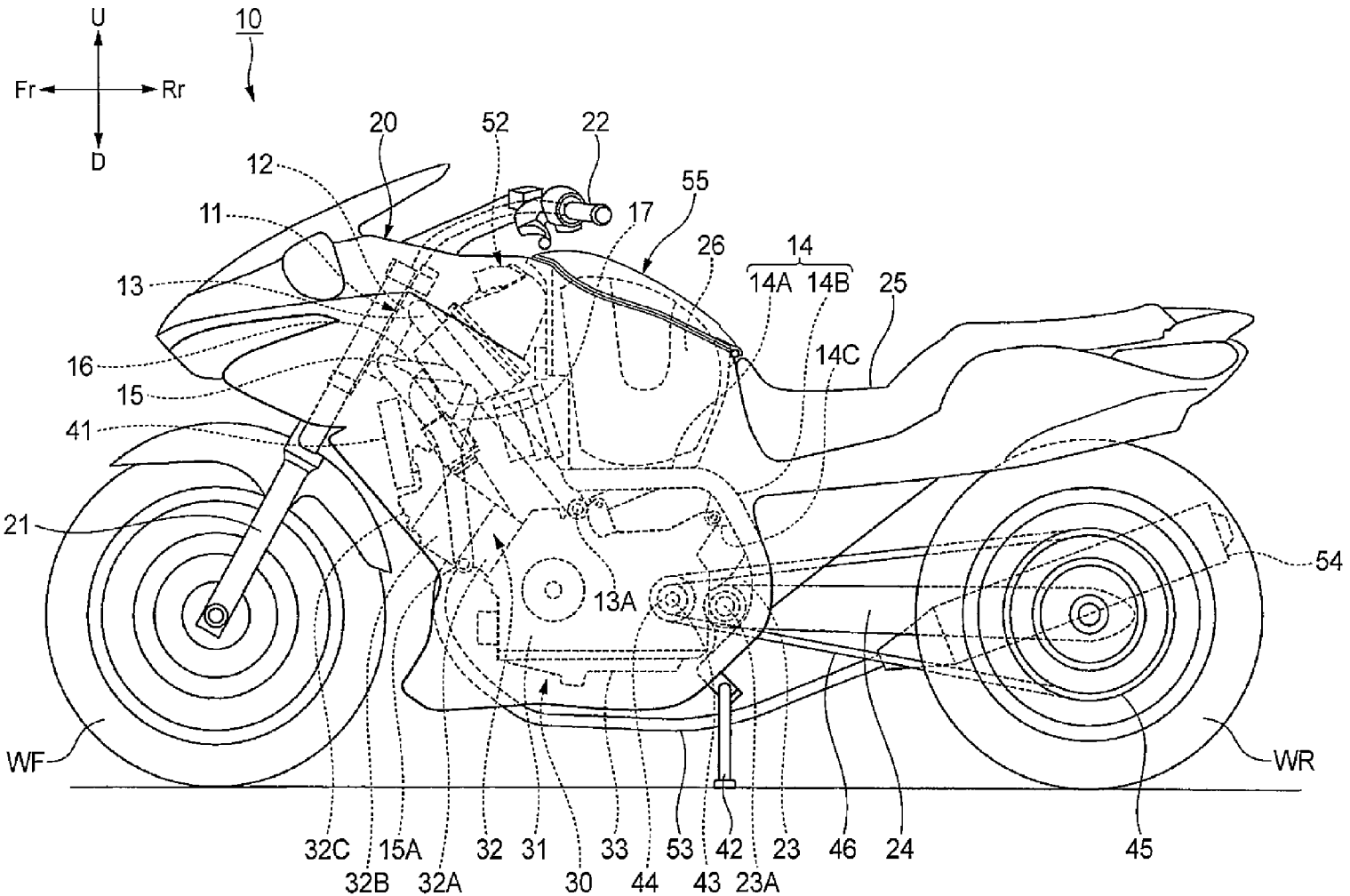
FIG. 1 is a left side elevational view of a motorcycle for explaining an embodiment of the present invention.

Referring to the drawings, detailed descriptions will be now provided for an embodiment of a motorcycle including an internal combustion engine of the present invention. It should be noted that: the drawings should be viewed in a direction which makes reference numerals legible; in the following descriptions, frontward, rearward, leftward, rightward, upward and downward are based on such directions taken from a standpoint of a driver, seated on the motorcycle and facing forward. Reference signs Fr, Rr, L, R, U and D in the drawings denote frontward, rearward, leftward, rightward, upward and downward of the vehicle, respectively.

As shown in FIG. 1, a motorcycle 10 including an internal combustion engine 30 (hereinafter referred to as an "engine" from time to time) of the depicted embodiment has a vehicle body frame 11. The vehicle body frame 11 is covered with a vehicle body cover 20 made of a synthetic plastic resin.

The vehicle body frame 11 includes: a head pipe 12 provided in a front end thereof; paired left and right main frames 13 extending obliquely downward from upper left and right portions of the head pipe 12 toward the rear; paired left and right center frames 14 extending horizontally from rear ends of the main frames 13 toward the rear, and thereafter extending downward while curving into an arc which projects toward the rear; and paired left and right down frames 15 extending obliquely downward from lower left and right portions of the head pipe 12 toward the rear. Although not illustrated, the vehicle body frame 11 further includes: paired left and right seat stays extending rearward from rear upper portions of the center frames 14, rear portions of the seat stays being connected together; and paired left and right middle frames extending rearward from rear end portions of the center frames 14, rear portions of the middle frames being connected together.

Paired left and right front forks 21 are supported by the head pipe 12 in such a way that the front forks 21 are steerable leftward and rightward. The front forks 21 extend downward, and a front wheel WF is pivotally supported by the lower ends of the front forks 21. A steering handlebar 22 is connected to an upper portion of the front forks 21. A pivot plate 23 is provided to the center frames 14. A front end of a rear fork 24 is supported by the pivot plate 23 in such a way that the rear fork 24 is turnable around the pivot bolt 23A. A rear wheel WR is pivotally supported by a rear end of the rear fork 24. The rear fork 24 is supported in such a way that the rear fork 24 is swingable with the assistance of a rear cushion, which is not illustrated.

A seat 25, obtained by combining a driver's seat and a pillion seat together, is provided above the paired left and right seat stays. Incidentally, although omitted from the illustration, a fuel tank is provided among the rear parts (among the seat stays and the middle frames) of the vehicle body frame.

First reinforcement frames 16 and second reinforcement frames 17 for connecting the main frames 13 and the down frames 15 which are vertically spaced out are provided between the main frames 13 and the down frames 15, respectively. The first reinforcement frames 16 extend rearward from front end portions of the down frames 15, and connect the down frames 15 and the main frames 13, respectively. The second reinforcement frames 17 extend downward from portions of the main frames 13, which are near rear ends of the first reinforcement frames 16, and connect the main frames 13 and the down frames 15, respectively.

An engine 30 is supported under the main frames 13 and horizontal portions 14A of the center frames 14, as well as in front of downwardly-extending portions 14B of the center frames 14. In the depicted embodiment, the engine 30 is a water-cooled parallel two-cylinder engine, and includes a cylinder unit 32, which is placed on an upper front portion of a crankcase 31 in a forward-tilted manner. With regard to the engine 30, another upper front portion of the crankcase 31 is supported by rear end portions 13A of the paired left and right main frames 13; a upper rear portion of the crankcase 31 is supported by paired left and right engine hangers 14C provided between the horizontal portions 14A and the rearward-extending portions 14B of the center frames 14; and the cylinder unit 32 is supported by rear end portions 15A of the paired left and right down frames 15.

Furthermore, the cylinder unit 32 includes: a cylinder block 32A integrally formed on the upper front portion of the crankcase 31; a cylinder head 32B connected to an upper portion of the cylinder block 32A; and a cylinder head cover 32C covering an upper portion of the cylinder head 32B. Moreover, an oil pan 33 is connected to a lower end portion of the crankcase 31. Additionally, a radiator 41 is placed in front of the cylinder head cover 32C, and a side stand 42 is attached to a lower end portion of the center frame 14 on the left side of the vehicle.

A rotary driving force outputted from the engine 30 is transmitted to the rear wheel WR via: an output shaft 43 projectingly provided to a rear left side surface of the crankcase 31; a drive sprocket 44 attached to the output shaft 43; a driven sprocket 45 attached to the left side of the rear wheel WR; and a drive chain 46 wound between the drive sprocket 44 and the drive sprocket 45.

Figure 2:
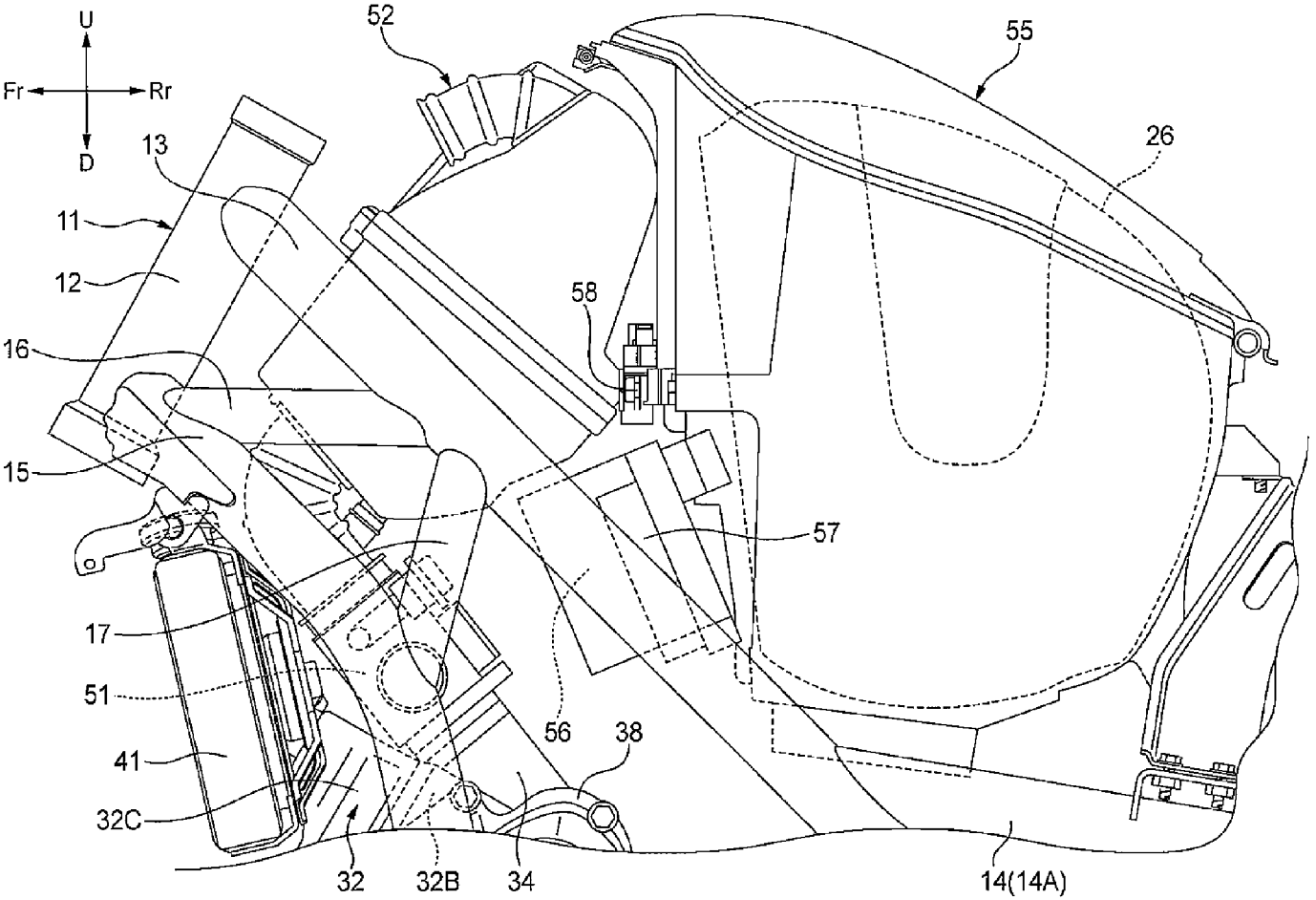
FIG. 2 is a magnified left side view of an air cleaner, a storage box and their vicinity, which are components of the motorcycle of FIG. 1.
Figure 3:
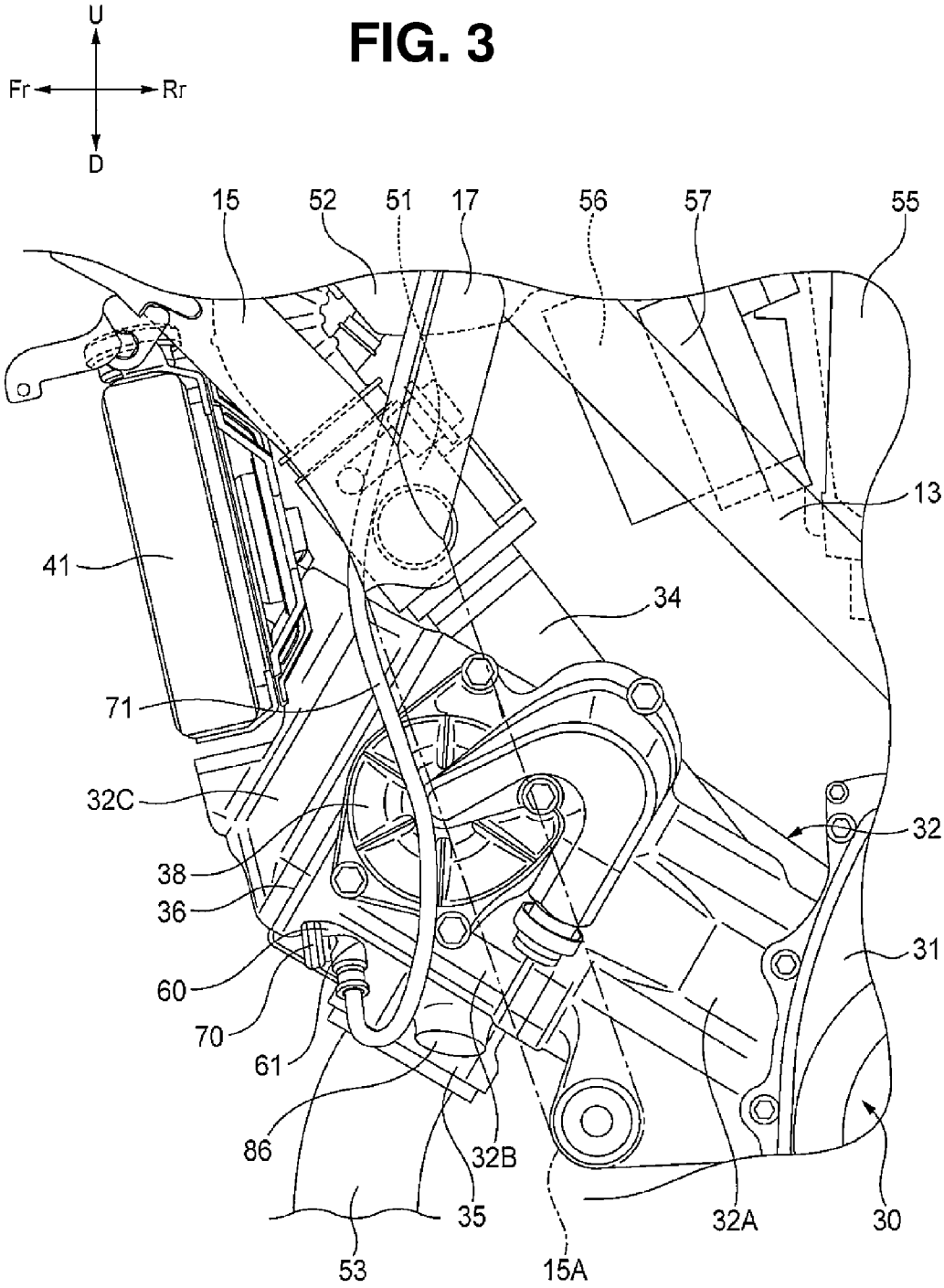
FIG. 3 is a magnified left side view of the cylinder unit of FIG. 1 and its vicinity.

Furthermore, as shown in FIG. 2, a throttle body 51 and an air cleaner device 52 included in an engine intake system are sequentially connected to an intake manifold section 34 formed behind the cylinder head 32B. Moreover, as shown in FIGS. 1 and 3, an exhaust pipe 53 and a muffler 54 included in an engine exhaust system are sequentially connected to an exhaust manifold section 35 formed in a front surface of the cylinder head 32B.

Additionally, as shown in FIG. 2, a storage box 55 having a capacity which enables a full-face type helmet 26 to be stored in the storage box 55 is placed in the rear of the air cleaner device 52 and above the paired left and right center frames 14. Also, a battery 56, a fuse box 57 and an inclination sensor 58 are provided between the air cleaner device 52 and the storage box 55.

In addition, as shown in FIGS. 4 to 7, spark plug wells 60, 60 which store their respective spark plugs (not illustrated) are formed in the front surface of the cylinder head 32B in such a way that the spark plug wells 60, 60 are symmetrical with respect to a center line CL of the vehicle in the left-right direction when the engine 30 is mounted on the vehicle. The number of cylindrical portions to be formed there depends on the number of cylinders (two cylinders in the case of the depicted embodiment).

Figure 4:
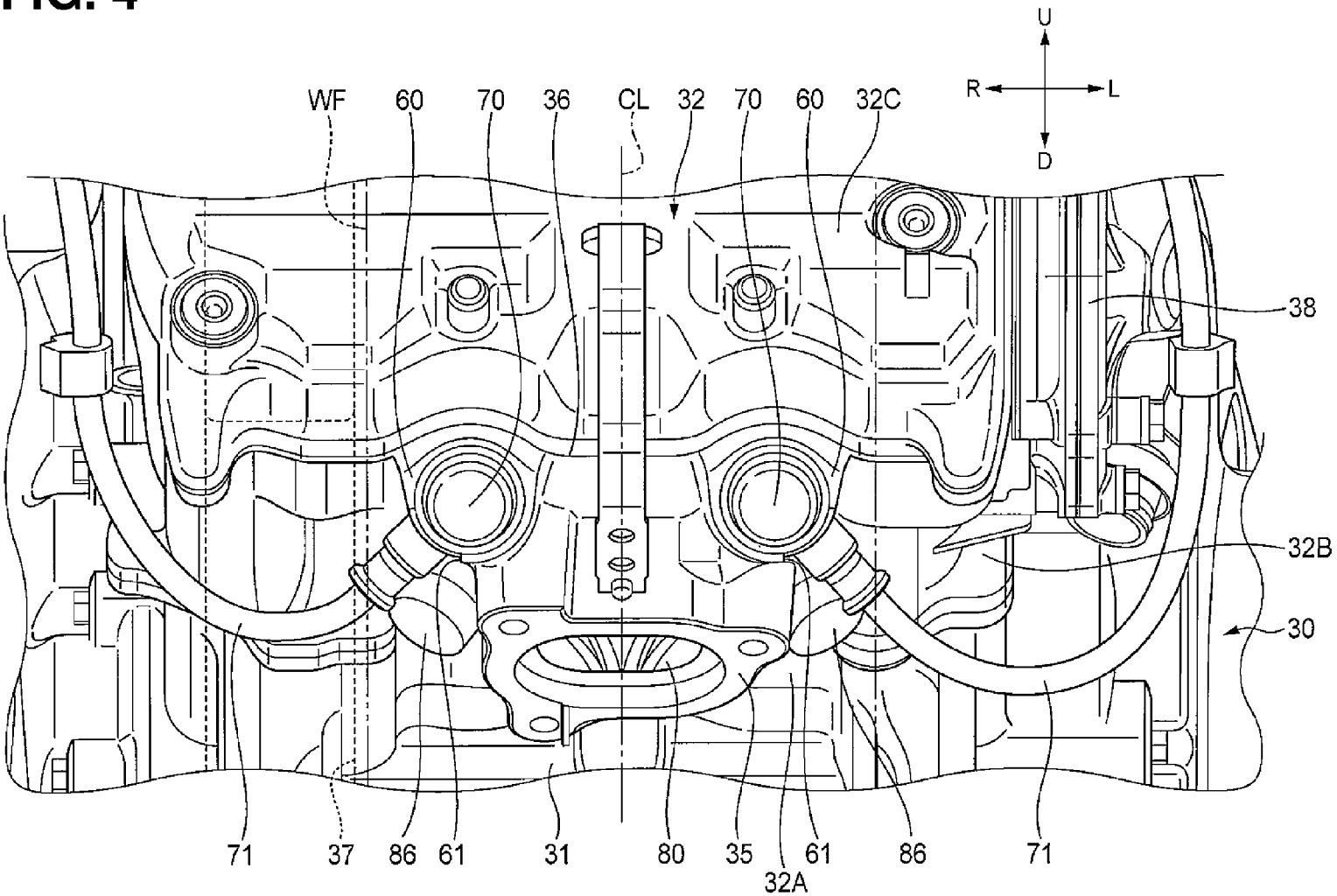
FIG. 4 is a front perspective view of the cylinder unit of FIG. 3 and its vicinity.
Figure 5:
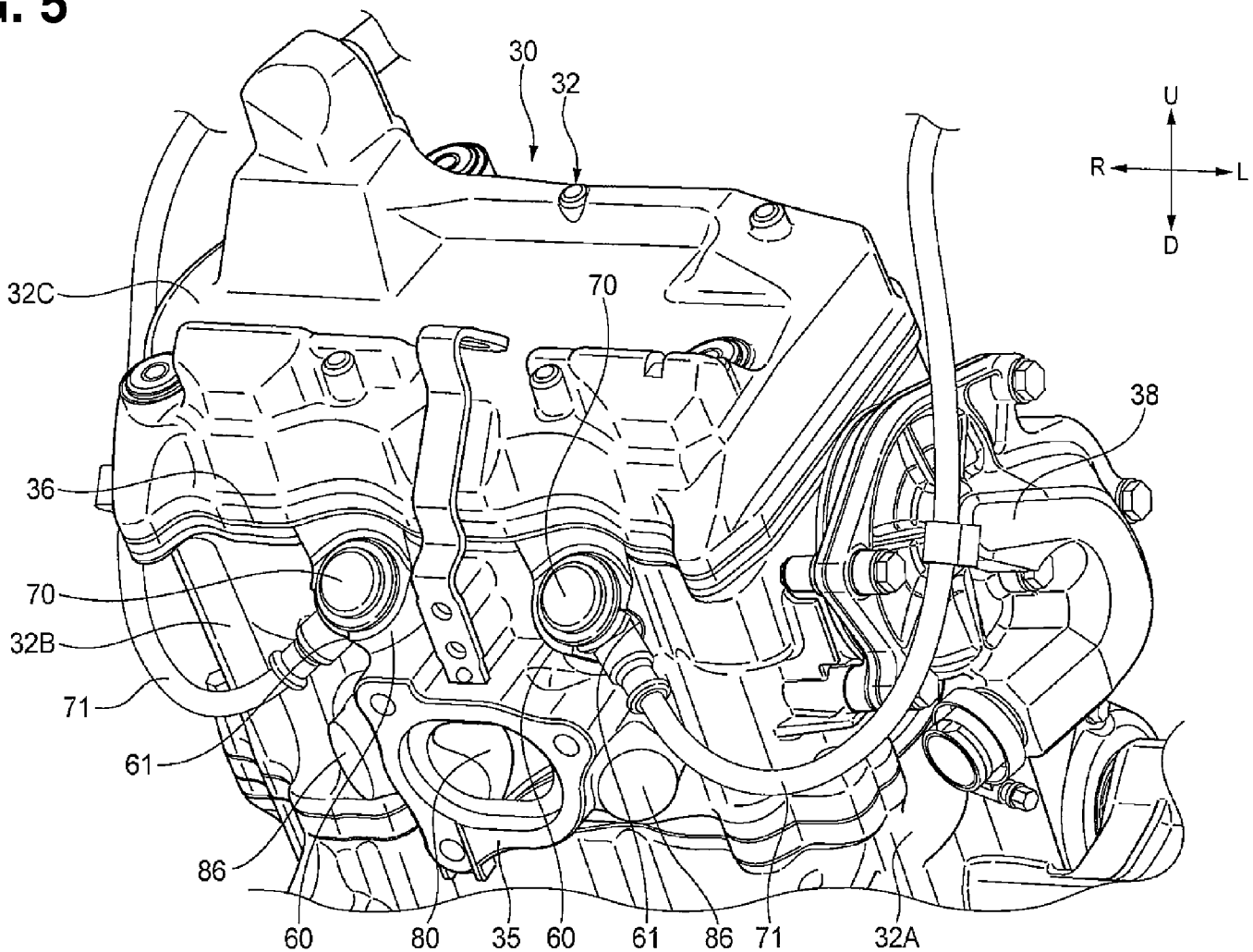
FIG. 5 is a magnified perspective view of the cylinder unit of FIG. 3 and its vicinity.

Furthermore, as shown in FIGS. 4 and 5, a spark plug cap 70 is fitted to each of the spark plug wells 60, 60. The spark plug cap 70 is connected to a spark plug (not illustrated) disposed inside the corresponding spark plug well 60. A high-tension ignition wire 71 is connected to a side surface of a top portion of the spark plug cap 70.

Moreover, as shown in FIGS. 4 to 7, a cut-out 61 shaped almost like the letter U is formed in a portion of each of the spark plug wells 60, 60, which projects above the cylinder head 32B. The cut-out 61 receives the corresponding ignition wire 71 while directing the ignition wire 71 toward the lateral side of the spark plug well 60.

Additionally, as shown in FIG. 3, each spark plug cap 70 is placed behind a lowermost end of a fastening surface 36 between the cylinder head cover 32C and the cylinder head 32B.

Figure 6:
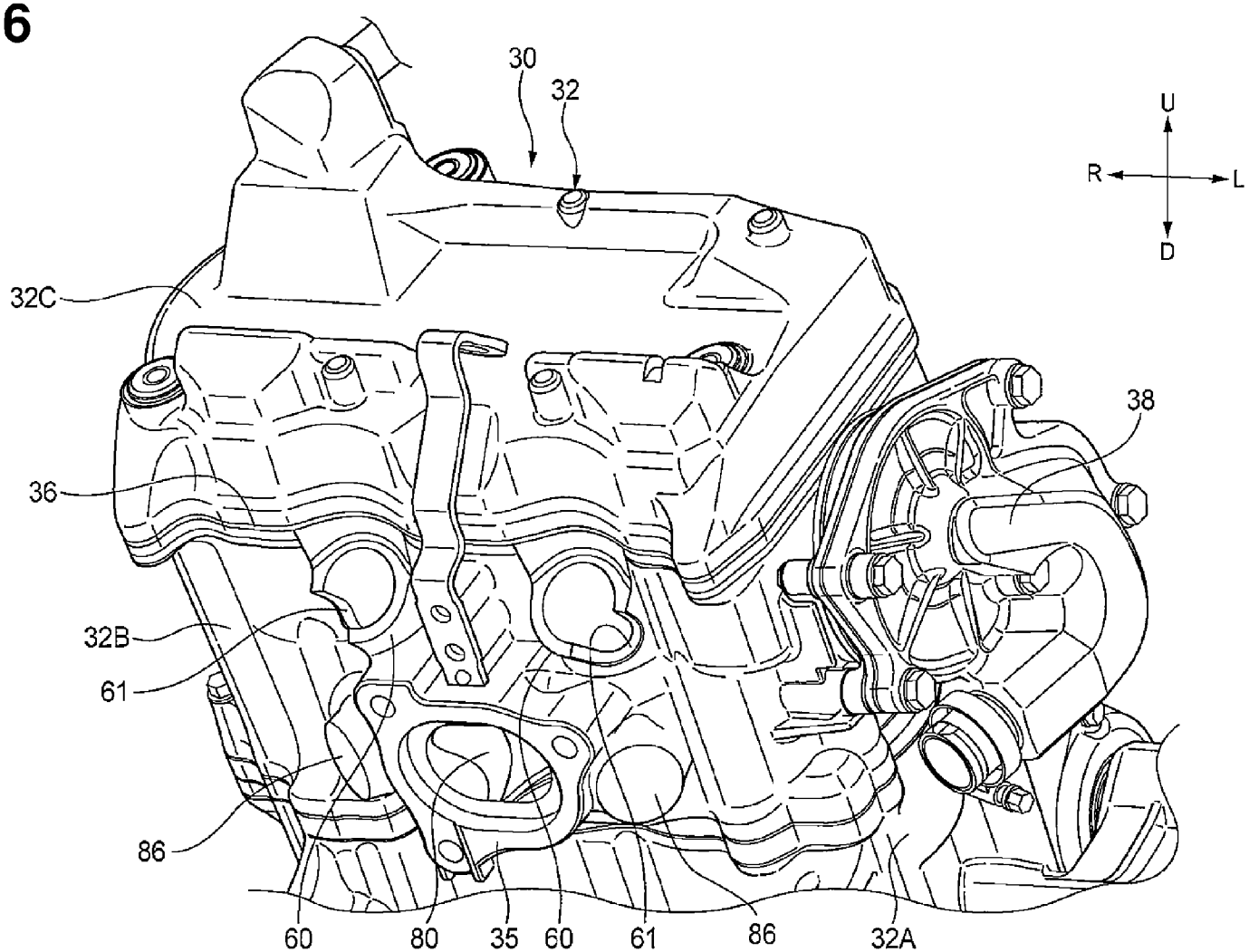
FIG. 6 is a magnified perspective view of the cylinder unit of FIG. 5 and its vicinity, with spark plug caps detached from a cylinder head thereof.

Also, as shown in FIGS. 4 to 6, the exhaust manifold section 35 is formed in the front surface of the cylinder head 32, between the paired left and right spark plug caps 70. The exhaust manifold section 35 includes exhaust ports 80 to which the exhaust pipe 53 is connected. In the depicted embodiment, the engine 30 expels exhaust gas from the cylinders (combustion chambers) in the cylinder head 32B through the exhaust ports 80.

Figure 8:
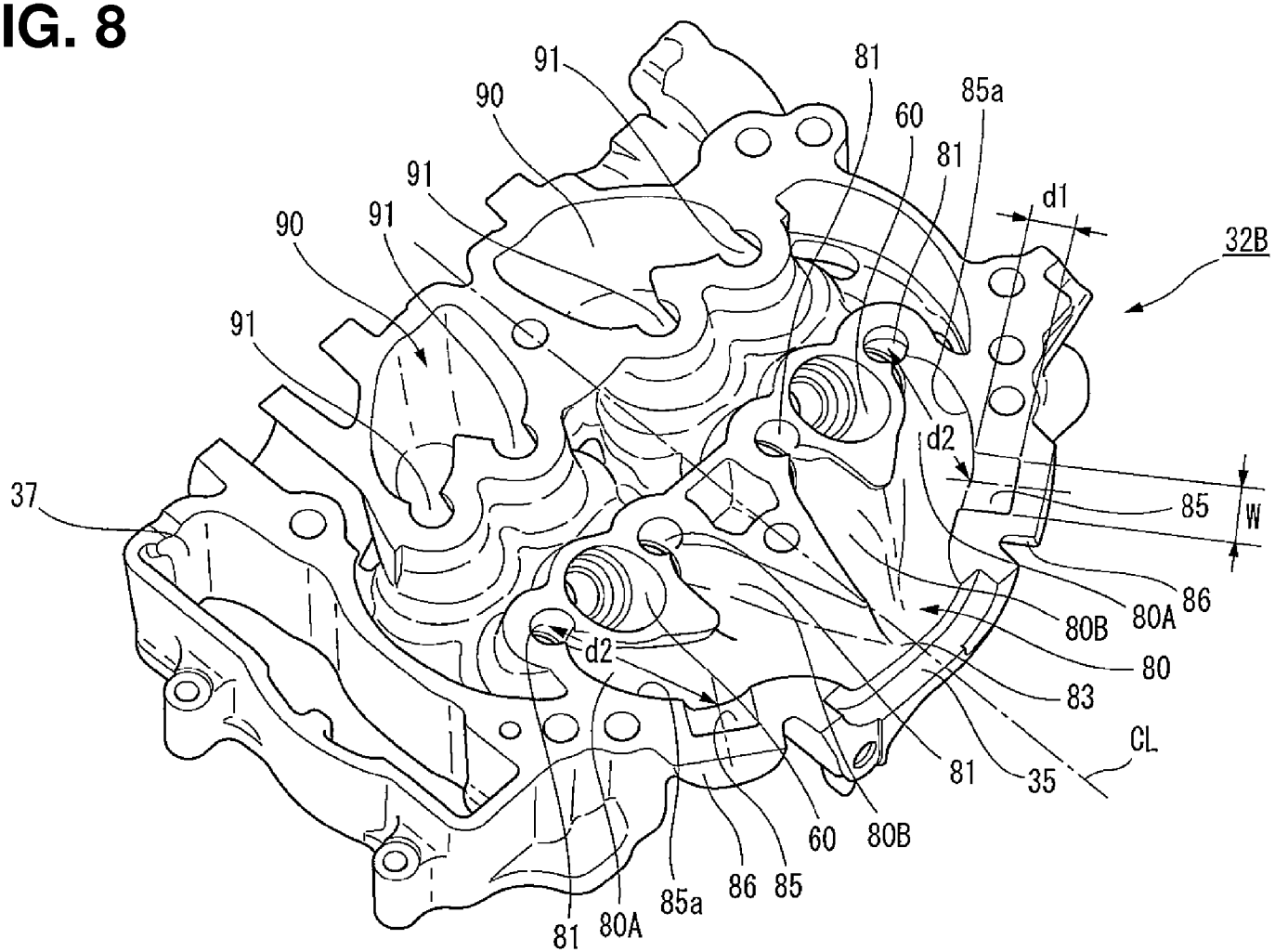
FIG. 8 is a cut-away perspective view of a lower section of the cylinder head 32, shown detached from the rest of the engine and with an upper half of the cylinder head removed therefrom for illustrative purposes.

An important feature of the inventive embodiment is provided by a structure in which, as shown in FIG. 8, each exhaust port 80 is provided with a recessed portion 85 formed therein, which is set back from an exhaust passage wall surface 85*a*, in the middle of its exhaust passage. Furthermore, in the depicted embodiment, each recessed portion 85 is formed, for example, as a substantially cylindrical space (see FIG. 9) having a volume (determined by a diameter W and a depth d1) which depends on the needs of an engineering design team.

It should be noted that a position in which each recessed portion 85 needs to be formed, as well as its shape and volume, may be determined with consideration given to various factors, inclusive of the structure and volume of the exhaust port 80 as well as the engine displacement.

In addition, as shown in FIG. 8, the cylinder head 32B is provided with: the two spark plug wells 60 serving as holes for the spark plugs; four intake valve holes 91 which join intake ports 90; and four exhaust valve holes 81 which join the exhaust ports 80.

Figure 7:
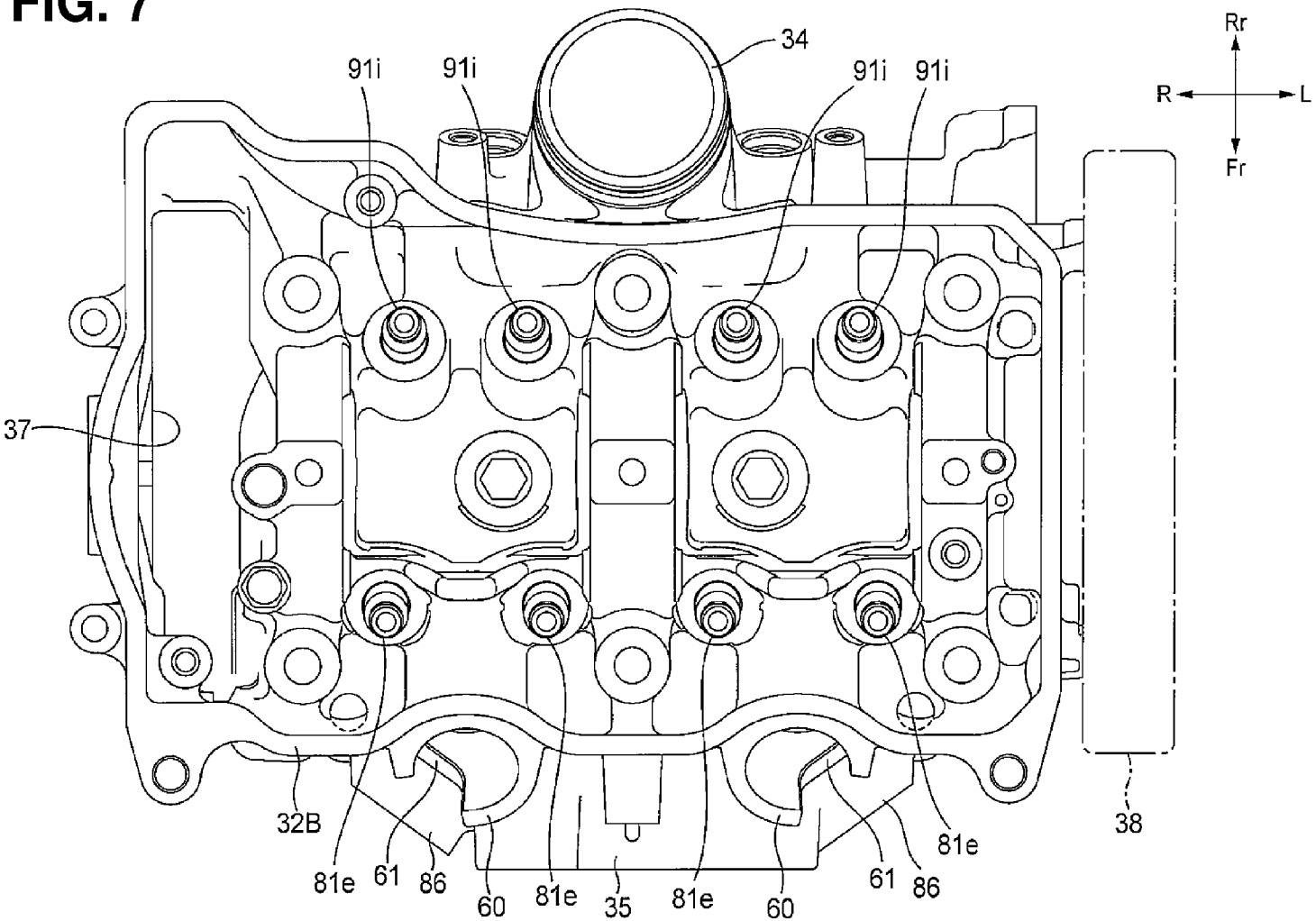
FIG. 7 is a top plan view of the cylinder head with its head cover detached.

In other words, the engine 30 of this embodiment is made up as a two-cylinder four-cycle engine using four valves per cylinder. The engine 30 has a configuration in which: as intake valve attachment portions 91*i*, valves fitted in the intake valve holes 91 project above the cylinder head 32B, while as exhaust valve attachment portions 81*e*, valves fitted in the exhaust valve holes 81 project above the cylinder head 32B, as shown in FIG. 7; and the intake valves and the exhaust valves, which are not illustrated, are driven by a camshaft or other appropriate valve mechanism, depending on the necessity.

Furthermore, in the engine 30 of the depicted embodiment, the two recessed portions 85 are formed corresponding to the respective cylinders. Accordingly, in each cylinder, the corresponding recessed portion 85 is capable of influencing the flow rate and flow velocity of the exhaust gas.

Moreover, the engine 30 of the depicted embodiment has a configuration in which the recessed portions 85 are provided upstream of a confluence section 83, in which the multiple exhaust ports 80 join together, in the exhaust flow. Additionally, the engine 30 has a structure in which, as a projecting portion 86 (see FIGS. 3 to 8), a part of the external surface of a wall portion forming any one exhaust port 80 slightly rises outward at an area where the corresponding recessed portion 85 is provided. That is to say, the engine 30 has the wall structure which has more recesses and protrusions.

The engine 30 of the depicted embodiment has the configuration in which the exhaust ports 80 include: two inner exhaust ports 80B; and two outer exhaust ports 80A placed outside the respective inner exhaust ports 80B. In addition, the outer exhaust ports 80A are designed in such a way that their downstream portions curve toward the corresponding inner exhaust ports 80B, and merge together to form the confluence section 83.

In the configuration of each exhaust port 80, its recessed portion 85 is placed in an area outside a curved portion of the corresponding outer exhaust port 80A. The recessed portion 85 is provided in the area which has a larger curvature than the rest of the exhaust passage wall surface 85*a* of the exhaust port 80.

As described above, the engine 30 of the depicted embodiment is provided with the two recessed portions 85, and the locations in which the two recessed portions 85 are formed are placed in such a way that the two recessed portions 85 pass the exhaust ports 80 and are symmetrical with respect to the center line CL of the cylinder head 32B.

As shown in FIG. 7, the upper half of the cylinder head 32B is fitted over the exhaust ports 80, so the shape of the exhaust ports 80 cannot be actually seen in an assembled configuration of the engine 30. For this reason, as a virtual space, the internal space of the exhaust port 80 is shown three-dimensionally in FIG. 9.

Figure 9:
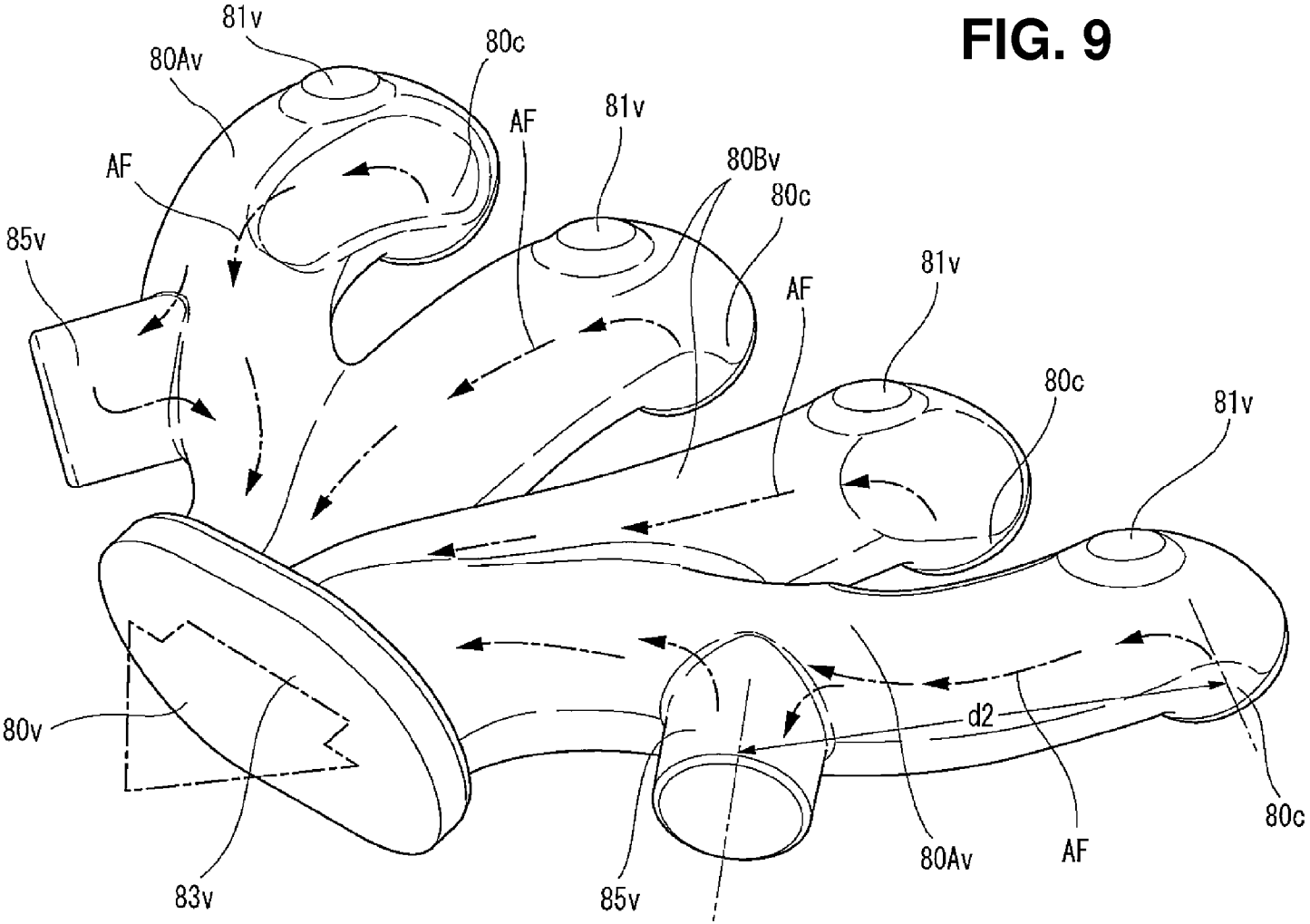
FIG. 9 is a perspective view of a virtual space representing an internal space in exhaust ports of the cylinder head of FIGS. 7-8.

FIG. 9 three-dimensionally shows the space occupied by an exhaust passage 80*v*, which represents the total of the exhaust passages of exhaust flows AF, as including: inner exhaust passages 80Bv corresponding to the two inner exhaust ports 80B; outer exhaust passages 80Av corresponding to the two outer exhaust ports 80A; and a confluence passage 83*v* into which all the passages join. Furthermore, recessed portion spaces 85*v* corresponding to the recessed portions 85 are formed, as cylindrical spaces, outside of the respective outer exhaust passages 80Av.

It should be noted that: spaces each having a slight expansion, which are penetrated by the corresponding valve stems of the exhaust valves, are formed; and for this reason, as exhaust valve penetration portions 81*v*, the spaces are schematically shown in FIG. 9.

When the engine 30 of the depicted embodiment is manufactured, the cylinder head 32B is manufactured by casting.

In this event, the formation of the recessed portions 85 requires nothing but the respective column-shaped cores during the casting. Accordingly, the engine can be manufactured through a manufacturing process which is almost the same as the conventional manufacturing process.

EXAMPLE

Figure 10:
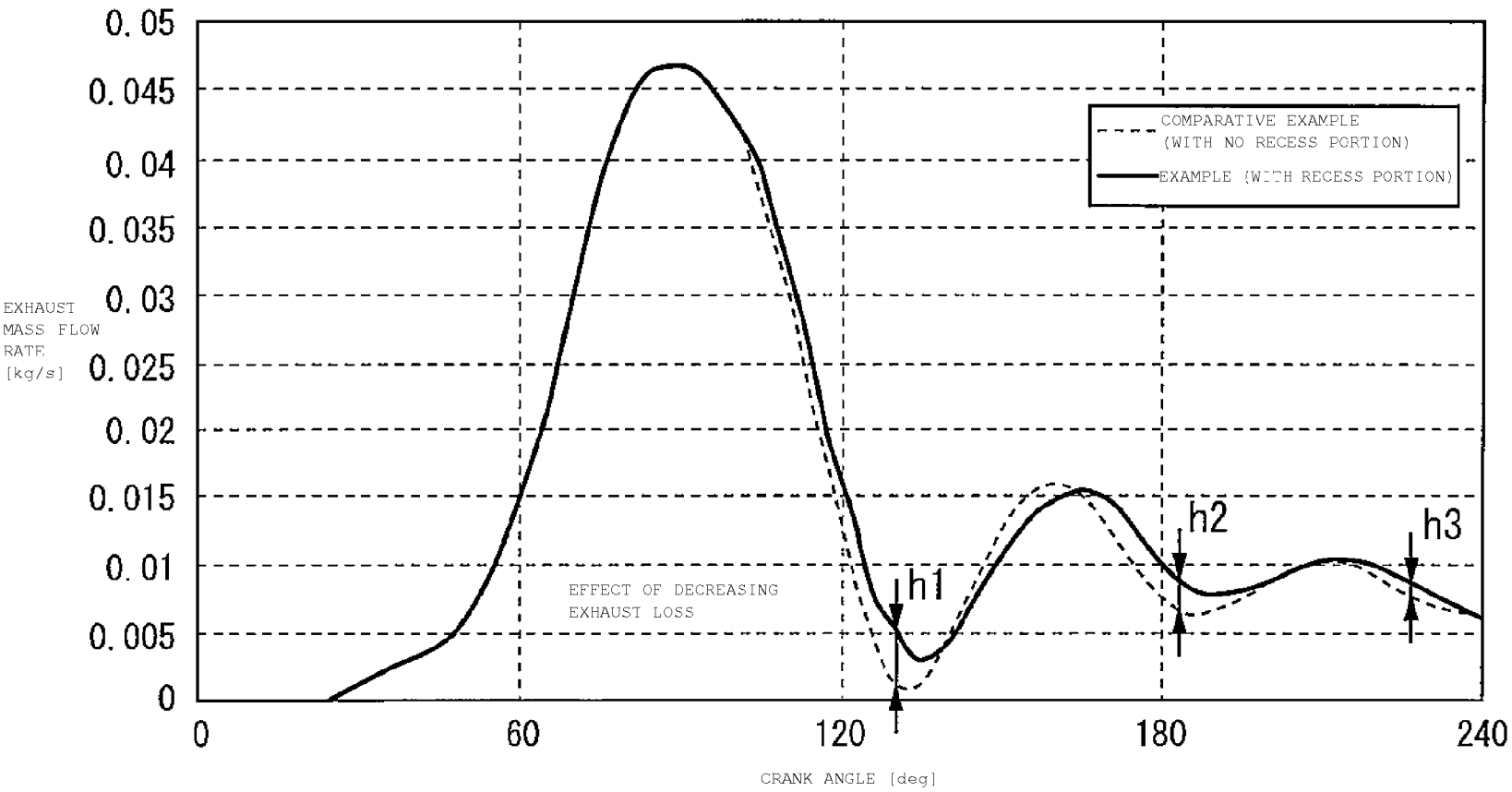
FIG. 10 is a graph showing mass flow rates which were observed in the respective exhaust ports of first and second test engines during a corresponding exhaust stroke.
Figure 11:
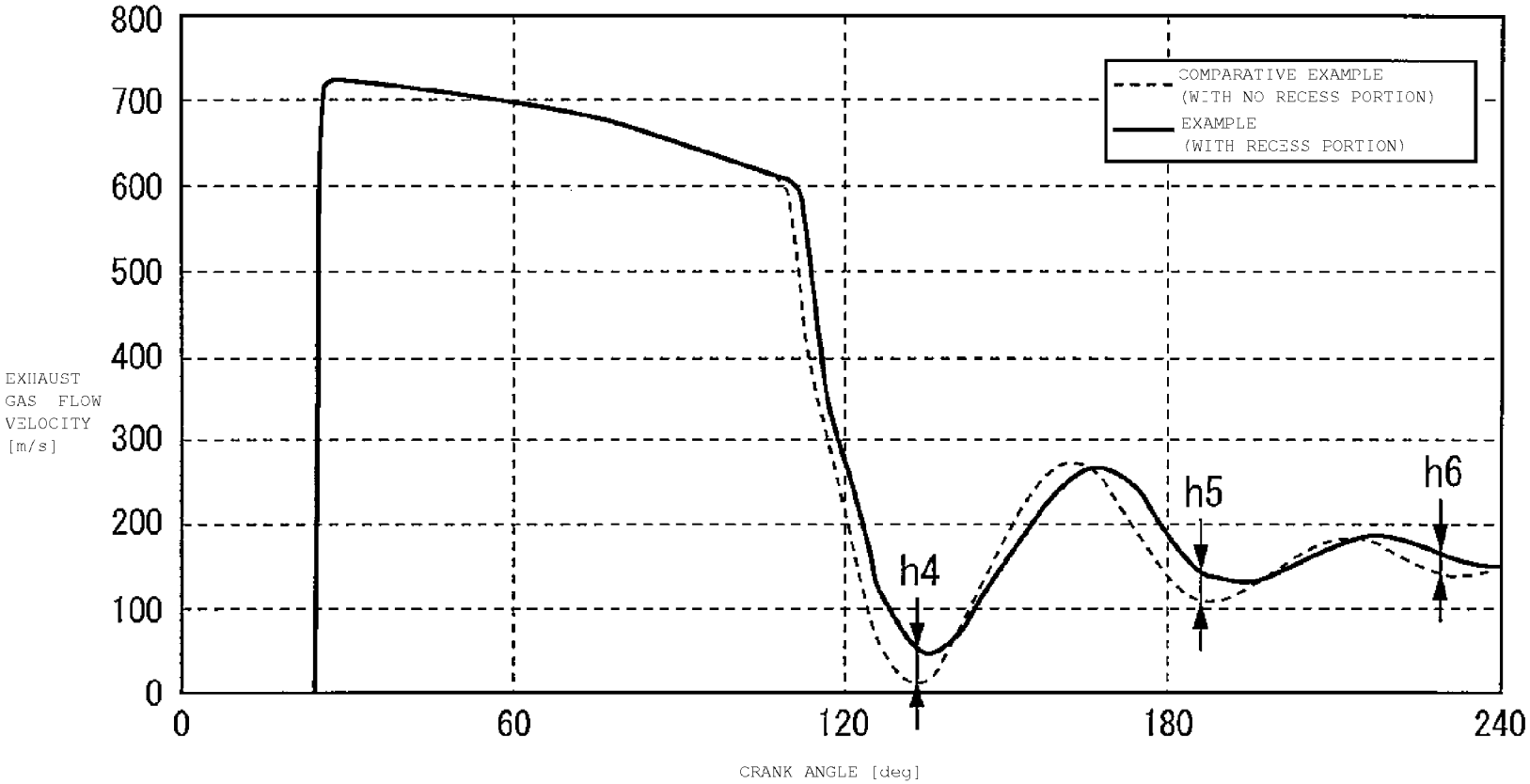
FIG. 11 is a graph showing flow velocities which were observed in the respective exhaust ports during their exhaust strokes.
Figure 12:
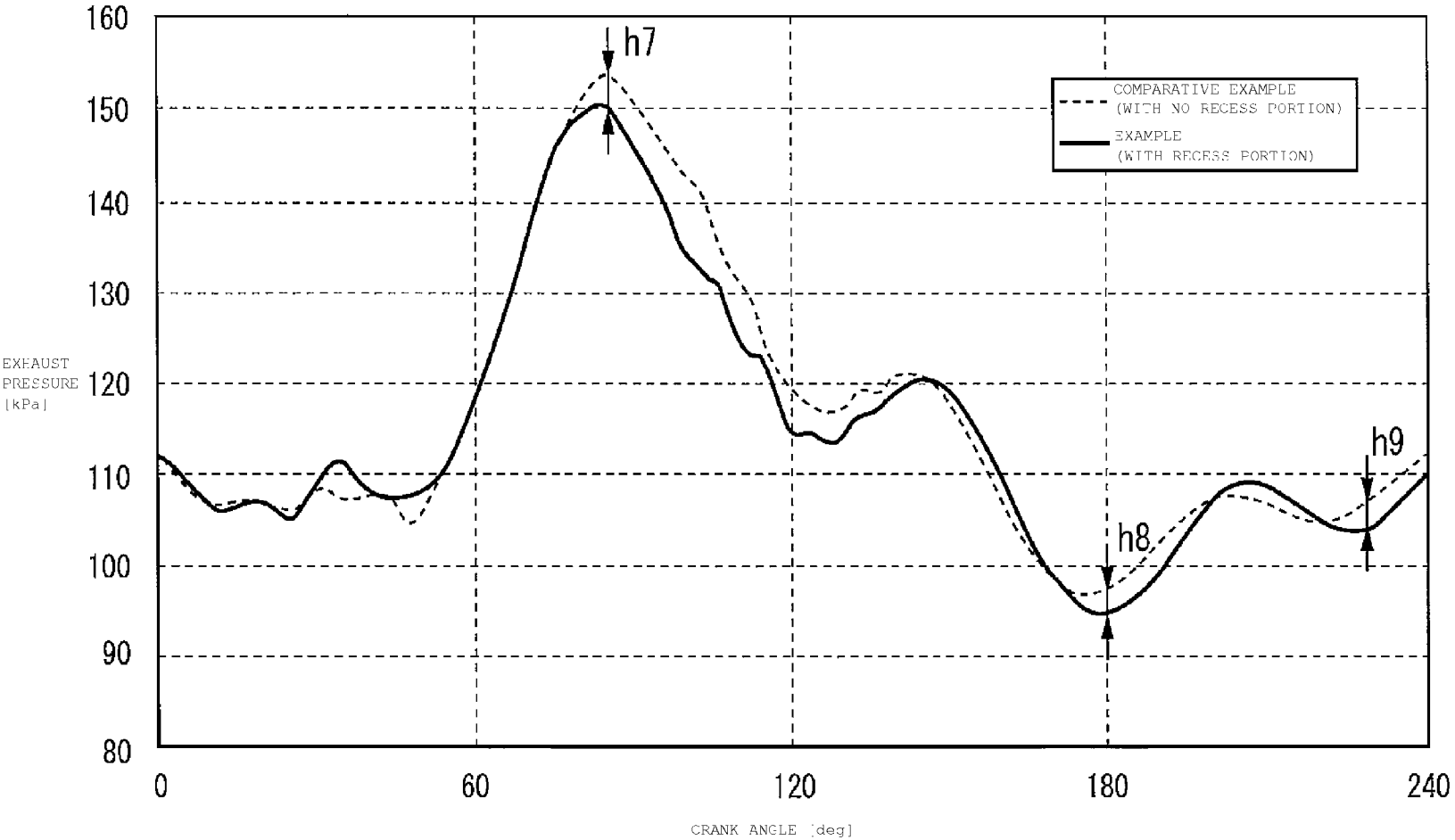
FIG. 12 is a graph showing exhaust pressures which were observed in the exhaust ports during their exhaust strokes.

Referring to FIGS. 10 to 12, descriptions will be hereinbelow provided for an example.

For each of the example provided with the recessed portions 85 and a comparative example provided with no recessed portion, data were measured on a flow rate of the exhaust gas flow (FIG. 10), a flow velocity of the exhaust gas flow (FIG. 11) and the exhaust pressure of the exhaust gas flow (FIG. 12).

It should be noted that in FIGS. 10 to 12, the data of the example is represented with a continuous line, and the data of the comparative example is represented with a dotted line.

Conditions for Example

Engine having the structure of the exhaust ports 80 shown in FIGS. 8 and 9

Engine to be used . . . 2-cylinder 4-cycle engine with a displacement of approximately 700 cc.

Capacity of each exhaust port 80 (excluding its recessed portion) . . . 131 cc (including its valve).

Dimensions of each recessed portion 85 (cylindrical shape) . . . 18 mm in diameter W, and 13 mm in depth d1.

Location in which the recessed portion 85 is formed . . . 618 mm in its distance d2 from the center of an opening portion 80*c* of the exhaust port (position substantially in the middle of the total length of the exhaust port).

Conditions for Comparative Example

Conditions for the comparative example were the same as those for the conditions for the above-mentioned example, except that no recessed portions 85 were included in the comparative example.

The comparison between data on the example and data on the comparative example showed an improvement in the flow rate of the exhaust gas in the example compared with that in the comparative example, because the reduction in the flow rate of exhaust gas became smaller in areas denoted by reference signs h1, h2 and h3 in the graph of FIG. 10.

In addition, the comparison showed an improvement in the flow velocity of the exhaust gas, which is shown in areas denoted by reference signs h4, h5 and h6 in the graph of FIG. 11. To put it specifically, the provision of the recessed portions 85 mitigated the reduction in the flow velocities of the exhaust gas flows AF in the later stages of the exhaust strokes.

Furthermore, with regard to the exhaust pressure, an effect of reducing the exhaust pressure in the later stages of the exhaust strokes was obtained as shown in areas denoted by reference sings h7, h8 and h9 in the graph of FIG. 12.

Descriptions will be now provided of how the engine 30 of the depicted embodiment works.

First of all, the intake valves and the exhaust valves are selectively opened and closed at appropriate times, depending on the necessity, on the basis of the operation of the valve mechanism configured to operate in conjunction with the drive of the engine 30.

To put it specifically, each time that each intake valve opens the corresponding intake port 90, the air-fuel mixture is sucked into the combustion chamber (cylinder) through the intake port 90, and is ignited in the combustion chamber by a spark from a spark plug. The heat energy produced by the combustion is converted to a motive power to be outputted, and after being transmitted through a number of components of the motorcycle's powertrain, the motive power is applied to the rear wheel WR of the motorcycle 10.

FIG. 9 is a perspective view of a virtual space representing a hollow internal space formed in exhaust ports of the cylinder head of FIGS. 7-8. For the exhaust gas flows AF produced by the combustion, four exhaust gas passages are formed, extending from the opening portions 80*c* of the exhaust ports toward the confluence passage 83*v*.

Portions of the exhaust gas flows AF discharged from the combustion chambers flow through the external exhaust passages 80Av, and parts of the portions thereof enter the recessed portion spaces 85*v* representing the recessed portions 85 formed in the exhaust ports 80.

Examples

A series of tests were run in an engine test laboratory comparing exhaust mass flow, exhaust flow velocity, and exhaust pressure in a first test engine, with a cylinder head having cylindrical recesses formed in the exhaust passages thereof according to the invention, compared to a second test engine used as a comparative example and having conventional exhaust passages without such recesses therein.

FIG. 10 is a graph showing mass flow rates which were observed in the respective exhaust ports of the first and second test engines during a corresponding exhaust stroke.

FIG. 11 is a graph showing flow velocities which were observed in the respective exhaust ports during their exhaust strokes.

FIG. 12 is a graph showing exhaust pressures which were observed in the exhaust ports during their exhaust strokes.

Referring to FIG. 10, the presence of recessed portions 85 in the cylinder head resulted in an improvement in the flow rate of the exhaust gas during engine operation, as compared to a comparative example manufactured without any recessed exhaust portions, as shown by height differences of the two graph lines in the areas indicated by reference signs h1, h2 and h3 in the graph of FIG. 10.

The graph of FIG. 10 illustrates that providing the recessed portions 85 in the cylinder head, according to the present invention, resulted in increased exhaust flow volume, as compared to the comparative example. In other words, the effect brought about by the modified chambers increases the flow of exhaust gas through the engine per unit time, and accordingly, makes it possible to reduce the exhaust loss of the exhaust gas, and contributes to an increase in engine torque.

In addition, with regard to the flow velocity of the exhaust gas, an increase in flow velocity was observed using the cylinder head according to the invention, as shown by the areas indicated by reference signs h4, h5 and h6 in the graph of FIG. 11.

The graph of FIG. 11 illustrates that providing the recessed portions 85 in the cylinder head, according to the present invention, resulted in increased exhaust flow velocity, as compared to the comparative example.

To put it specifically, the inclusion of the recessed portions 85 helps to maximize the flow velocities of the exhaust gas flows AF in the later stages of the exhaust strokes, and reduces the exhaust loss. As a result, the engine torque can be increased.

Furthermore, with regard to exhaust pressure, a decrease in such pressure was observed using the cylinder head having the recessed portions therein, as shown by the areas indicated by reference signs h7, h8, h9 in the graph of FIG. 12.

To put it specifically, the inclusions of the recessed portions 85 enables the effect brought about by the simplified resonance chambers to be exerted, and makes it possible to reduce the exhaust loss which occurs during the gas exchange in each cylinder. Particularly, an effect of reducing the exhaust pressure in the later stage of each exhaust stroke can be obtained.

Accordingly, it will be seen from the above discussion that the provision of the recessed portions 85 to the respective cylinders enables each cylinder to increase the flow rate of the corresponding exhaust gas, to increase the flow velocity of the exhaust gas, and to reduce the exhaust pressure. Accordingly, it is possible to effectively increase the engine output.

Each recessed portion 85 is provided outside the location where the corresponding passage curves to a large extent, and the curvature is large in the inner wall surface of the corresponding exhaust port 80. This makes it possible to increase the volume of each exhaust port 80 effectively, and makes the exhaust flow smoothly, as well as preventing exhaust loss. Additionally, the conditions for the placement positions where the respective recessed portions 85 are formed are all the same among the cylinders. This makes it possible to equalize the outputs from the respective cylinders by suppressing the occurrence of the variation among the outputs, and thus, effectively enhances engine output.

Each recessed portion is placed outside the area where the corresponding outer exhaust port is curved, that is to say, in an area constituting a small space (a curved unoccupied space) which is created by inwardly curving a corresponding portion of the cylinder head. This makes it possible to use the space efficiently, and the size of the area in which each recessed portion is provided can be accordingly allowed to be increased. Furthermore, the structure in which each recessed portion 85 is provided in the corresponding exhaust port imposes no restriction on the layout of the engine's peripheral components, because, as learned from the FIGS. 3 to 8, the outer appearance of the area where the recessed portion 85 is formed only includes a slightly projecting portion 86 which is formed there.

Moreover, the area in which each recessed portion 85 is provided has a structure in which the wall portion constituting the corresponding exhaust port 80 has recesses and projections depending on the necessity. This increases the rigidity of the area near the confluence section.

In addition, in the depicted embodiment, each recessed portion 80 is formed in a cylindrical shape. This makes it easier to expel sand during the casting process through which the cylinder head is produced, than when each recessed portion 80 is shaped like, for example, a square recess having angled corners.

In the above-described embodiment, application of the present invention to a motorcycle engine has been described. However, the present invention is not limited to this, and may be applied to other types of vehicles. In addition, the shape and size of the recessed portions of the foregoing embodiment, the number of the recessed portions, the direction in which the recessed portions are opened, the locations in which the respective recessed portions are formed, and the like may be changed, depending on the necessity with the other conditions of the engine taken into consideration.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An internal combustion engine which is configured to expel exhaust from a combustion chamber of a cylinder through an exhaust port of a cylinder head which is operatively connected to an exhaust pipe, wherein the cylinder head has an exhaust passage formed therein and having a wall surface with a hollow recessed portion formed therein and extending away from other portions of the exhaust passage wall surface, said recessed portion provided in a central portion of said exhaust passage and defining a resonance chamber for reducing exhaust pulsation, and wherein the recessed portion is formed as a hollow space cast inside of the cylinder head during manufacture thereof.

2. The internal combustion engine according to claim 1, wherein the internal combustion engine comprises a plurality of cylinders, and a separate recessed portion is formed in the cylinder head for each of said cylinders.

3. The internal combustion engine according to claim 1, wherein the recessed portion is provided upstream of a confluence section formed in the cylinder head, in which a plurality of exhaust ports join together in the exhaust passage.

4. The internal combustion engine according to claim 2, wherein each of the recessed portions is provided upstream of a confluence section formed in the cylinder head, in which a plurality of exhaust ports join together in the exhaust passage.

5. The internal combustion engine according to claim 1, wherein the recessed portion is provided in an area of the exhaust passage in which a curvature of an inner wall thereof is large.

6. The internal combustion engine according to claim 1, wherein:

a plurality of the recessed portions are provided, the exhaust ports comprise a plurality of inner exhaust ports and a plurality of outer exhaust ports which are placed laterally outside of the respective inner exhaust ports, the outer exhaust ports are designed to curve toward the respective inner exhaust ports, and a respective one of said recessed portions is placed outside a curved portion of each outer exhaust port.

7. The internal combustion engine according to claim 1, wherein a plurality of the recessed portions are provided, and wherein the recessed portions are situated proximate the exhaust ports, and are substantially symmetrical with respect to a center line of the cylinder head.

8. The internal combustion engine according to claim 1, wherein an internal space of the recessed portion is formed in a substantially cylindrical shape, and wherein an external projection is formed on a portion of the cylinder head outside of the recessed portion.

9. The internal combustion engine according to claim 2, wherein an internal space of each recessed portion is formed in a substantially cylindrical shape, and wherein an external projection is formed on a portion of the cylinder head outside of each recessed portion.

10. A method of manufacturing the internal combustion engine of claim 1, wherein each recessed portion is formed by using a core in a process of casting the cylinder head.

11. A cylinder head for an internal combustion engine, said cylinder head comprising an exhaust passage having a wall surface with a hollow recessed portion formed therein and extending away from adjacent portions of the exhaust passage wall surface, said recessed portion provided in a central portion of said exhaust passage and defining a resonance chamber for reducing exhaust pulsation, and wherein the recessed portion is formed as a hollow space cast inside of the cylinder head during manufacture thereof.

12. The cylinder head according to claim 11, wherein the cylinder head is configured for use on an internal combustion engine which comprises a plurality of cylinders, and a separate recessed portion is formed in the cylinder head for each of said cylinders.

13. The cylinder head according to claim 11, wherein the recessed portion is provided upstream of a confluence section formed in the cylinder head, in which a plurality of exhaust ports join together in the exhaust passage.

14. The internal combustion engine according to claim 11, wherein the recessed portion is provided in an area of the exhaust passage in which a curvature of an inner wall thereof is large, and wherein an external projection is formed on a portion of the cylinder head outside of the recessed portion.

15. The cylinder head according to claim 11, wherein:

a plurality of recessed portions are provided in the cylinder head, the exhaust ports comprise a plurality of inner exhaust ports and a plurality of outer exhaust ports which are placed laterally outside of the respective inner exhaust ports, the outer exhaust ports are designed to curve toward the respective inner exhaust ports, and a respective one of said recessed portions is placed outside a curved portion of each outer exhaust port.

16. The cylinder head according to claim 11, wherein a plurality of recessed portions are provided in the cylinder head, and wherein the recessed portions are situated proximate the exhaust ports, and are substantially symmetrical with respect to a center line of the cylinder head.

17. The cylinder head according to claim 11, wherein an internal space of each recessed portion is formed in a substantially cylindrical shape.

18. A cylinder head for a multi-cylinder internal combustion engine having a plurality of cylinders, said cylinder head comprising an exhaust passage having a wall surface with a hollow recessed portion formed therein for each of said cylinders, respectively, wherein each of said recessed portions extends away from adjacent portions of the exhaust passage wall surface, said recessed portion provided in a central portion of said exhaust passage and defining a resonance chamber for each of said cylinders, respectively, said resonance chamber configured for reducing exhaust pulsation, and wherein the recessed portion is formed as a hollow space cast inside of the cylinder head during manufacture thereof.

19. The cylinder head according to claim 18, wherein:

the cylinder head is configured for use with an engine having four valves per cylinder, the cylinder head has two exhaust ports formed therein for each cylinder, the exhaust ports of the cylinder head comprise a plurality of inner exhaust ports and a plurality of outer exhaust ports which are placed laterally outside of the respective inner exhaust ports, and a respective one of said recessed portions is placed outside a curved portion of each outer exhaust port, such that only the outer exhaust port of each cylinder is provided with one of said recesses.

20. The cylinder head according to claim 18, wherein an internal space of each recessed portion is formed in a substantially cylindrical shape.

* * * * *